US005771298A

United States Patent [19]

Davis et al.

[11] Patent Number: 5,771,298

[45] **Date of Patent: *Jun. 23, 1998**

[54] APPARATUS AND METHOD FOR SIMULATING A HUMAN MASTOID

[75] Inventors: Larry J. Davis, Highland; Robert Chanaud, Orem, both of Utah

[73] Assignee: Larson-Davis, Inc., Provo, Utah

[ * ] Notice: The term of this patent shall not extend beyond the expiration date of Pat. No. 5,624,377.

[21] Appl. No.: 782,150

[22] Filed: Jan. 13, 1997

[51] Int. Cl.[6] ..... H04R 29/00

[52] U.S. Cl. ..... 381/60; 381/151; 600/25

[58] Field of Search ..... 381/60, 151; 600/25; 607/55, 56, 57

[56] References Cited

U.S. PATENT DOCUMENTS

| | | |
|---|---|---|
| 1,698,407 | 1/1929 | Johnson . |
| 2,910,539 | 12/1959 | Hartsfield . |
| 2,957,954 | 10/1960 | Swinehart . |
| 3,019,307 | 1/1962 | Weiss . |
| 3,030,456 | 4/1962 | Knauert . |
| 4,095,057 | 6/1978 | Power et al. . |
| 4,606,329 | 8/1986 | Hough . |
| 4,988,333 | 1/1991 | Engerbretson et al. . |
| 5,218,337 | 6/1993 | Peter . |
| 5,277,694 | 1/1994 | Leysieffer et al. . |
| 5,425,107 | 6/1995 | Bertagni et al. . |

OTHER PUBLICATIONS

Audiological Test Equipment Group 17, pp. 673–676, "Artificial Mastoid Artificial Mastoid with Calibrator".

American National Standard "Reference Equivalent Threshold Force Levels for Audiometric Bone Vibrators", pp. 1–8.

International Standard "Mechanical Coupler for Measurements on Bone Vibrators".

American National Standard, Mechanical Coupler for Measurement of Bone Vibrators.

International Electrotechnical Commission, An IEC artificial ear, of the wide band type, for the calibration of earphones in audiometry 1970.

*Primary Examiner*—Forester W Isen

*Attorney, Agent, or Firm*—Thorpe, North & Western, LLP

[57] ABSTRACT

An apparatus and method for simulating a human mastoid is disclosed. The apparatus includes a diaphragm having a mass, springiness and damping means sufficient to more closely replicate the impedance of a human head bone and skin overlying the same, than prior art testing devices. In a preferred embodiment, the method includes placing the diaphragm over the central opening of an artificial ear and placing a bone conduction hearing aid on top of the diaphragm. A microphone disposed below the opening measures the sound generated by the vibration. These measurements provides an indication of whether the bone conduction hearing aid is functioning properly. The apparatus and method are not only easier to use and less expensive than prior art devices and methods, they are also as accurate, if not more accurate.

46 Claims, 13 Drawing Sheets

Temperature Response Relative to 23 °C

| °C | 250 | 500 | 750 | 1000 | 1500 | 2000 | 3000 | 4000 | 6000 |
|---|---|---|---|---|---|---|---|---|---|
| 15 | -3.9 | -0.9 | -2.9 | -3.4 | -3.5 | -1.3 | -1.5 | -0.4 | 0.5 |
| 16 | -3.9 | -0.8 | -2.7 | -3.3 | -3.4 | -1.2 | -1.4 | -0.3 | 0.5 |
| 17 | -3.8 | -0.8 | -2.5 | -3.2 | -3.3 | -1.1 | -1.3 | -0.2 | 0.4 |
| 18 | -3.4 | -0.6 | -2.3 | -2.9 | -3 | -1 | -1.2 | -0.1 | 0.4 |
| 19 | -3 | -0.5 | -2.2 | -2.7 | -2.8 | -0.9 | -1.2 | -0.1 | 0.3 |
| 20 | -2.3 | -0.4 | -1.8 | -2 | -2.1 | -0.7 | -1 | -0.1 | 0.2 |
| 21 | -1.6 | -0.3 | -1.4 | -1.3 | -1.4 | -0.5 | -0.7 | -0.1 | 0.2 |
| 22 | -0.8 | -0.1 | -0.7 | -0.6 | -0.7 | -0.2 | -0.4 | 0 | 0.1 |
| 23 | 0 | 0 | 0 | 0 | 0 | 0 | 0 | 0 | 0 |
| 24 | 0.7 | 0.1 | 0.8 | 0.8 | 0.7 | 0.2 | 0.3 | 0 | -0.2 |
| 25 | 1.4 | 0.3 | 1.5 | 1.5 | 1.4 | 0.4 | 0.6 | 0 | -0.4 |
| 26 | 2 | 0.5 | 2.2 | 2.3 | 2 | 0.5 | 1.1 | 0.1 | -0.7 |
| 27 | 2.7 | 0.8 | 2.8 | 3 | 2.6 | 0.7 | 1.5 | 0.2 | -0.9 |
| 28 | 3.5 | 1.2 | 3.5 | 3.8 | 3.1 | 0.8 | 2.3 | 0.4 | -1.1 |
| 29 | 4.3 | 1.5 | 4.2 | 4.6 | 3.6 | 0.9 | 3 | 0.5 | -1.3 |
| 30 | 5 | 1.9 | 5 | 5.5 | 4.3 | 1 | 3.7 | 0.7 | -1.4 |
| 31 | 5.6 | 2.3 | 5.7 | 6.3 | 4.9 | 1.1 | 4.4 | 0.9 | -1.6 |
| 32 | 6.1 | 2.7 | 6.2 | 6.9 | 5.4 | 1.1 | 5.1 | 1 | -1.8 |
| 33 | 6.7 | 3 | 6.7 | 7.4 | 5.8 | 1.2 | 5.8 | 1 | -2 |
| 34 | 7.3 | 3.3 | 7.2 | 7.9 | 6.1 | 1.3 | 6.3 | 1 | -2.8 |
| 35 | 7.9 | 3.5 | 7.7 | 8.4 | 6.4 | 1.5 | 6.9 | 0.9 | -3.6 |

Fig. 11A

Temperature Response Relative to 23 °C

| Group | RAH Range | Temperature Range | Frequency Range | Response, dB |
|---|---|---|---|---|
| Dry | less than 40 | 15 to 35 | All | 0 |
| Normal | 40 to 60 | 15 to 35 | All | 0 |
| Moist | 60 to 80 | 15 to 35 | 250 to 1500 | 1 - ΔT/5 |
| | | | 2000 to 6000 | 0 |
| Tropical | 0 to 100 | 15 to 23 | 250 to 1500 | 2.5 - ΔT/1.5 |
| | | | 2000 to 6000 | 0 |
| | | 24 to 35 | 250 to 1500 | 2.5 - ΔT/4 |
| | | | 2000 to 6000 | 0 |

Fig. 11B

APPARATUS AND METHOD FOR SIMULATING A HUMAN MASTOID

BACKGROUND OF THE INVENTION

The present invention relates to an apparatus and method for simulating a human mastoid, and, in particular, to an apparatus and method for testing hearing aids and testing devices which are of the bone conduction type, so as to ensure that the hearing aid conforms with accepted standards for overcoming the impedance provided by the human mastoid.

Those skilled in the art of hearing aids and related equipment are familiar with the long-felt need to develop a reproducible standard for measuring the ability of a bone conduction hearing device to overcome the impedance of the human mastoid (or other bones in a human skull) and the skin disposed thereon. Additionally, those skilled in the art will recognize that there is also a long-felt need for a device which may be used to ensure compliance with uniform standards which are currently in place.

In many hearing impaired people, portions of the middle ear have been damaged or are otherwise such that simple amplification of the sound is insufficient to enable the person to hear. To overcome this problem, a bone conductive hearing device essentially bypasses the function of the middle ear by propagating vibration to the inner ear via the mastoid or other cranial bone. Thus, the bone conductive hearing device is typically an electromechanical transducer intended to produce the sensation of hearing by vibrating the cranial bones. This is typically done by placing a bone conduction hearing device behind the ear of the user or on the forehead so that a vibrating element of the hearing device rests on the skin which covers one of the bones of the skull. The vibrational force generated by the bone conduction hearing device is applied to the skin. The vibrations travel through the skin and the mastoid bone and are received by the inner ear in a manner similar to that in which the inner ear receives the vibrations of the inner ear in a person with normal hearing.

In order to determine whether bone conductive hearing aids are operating properly, it is necessary to establish a standard of measuring the devices, as well as a testing mechanism for implementing a standard. Additionally, such a standard and mechanism may also be used to test a human mastoid to determine if it functions normally in response to vibratory force. Several approaches have been made in each regard.

In U.S. Pat. No. 3,019,307, a device for measuring a reproducible standard for bone conduction receiver measurement is proposed. The standard to which the device is drawn was the result of the National Bureau of Standards and was described in detail in the Journal of the Acoustical Society, November 1955. An electrical equivalent circuit diagram of a machine proposed for testing a hearing device for use on an average mastoid respective to the standard is shown in FIG. 1A. In FIG. 1A, the representation of a bone conduction receiver positioned against a human head includes an inductor, m, which represents the mass of the skin and bone vibrated by the receiver, a resistor, r, which represents the viscous damping due to the skin, and a capacitor, 1/k, which represents the compliance or springiness of the skin.

To implement this circuit, a fairly complex, expensive and bulky machine was used. A cross-sectional view of one embodiment of the machine is provided in FIG. 1B. A bone conduction vibrator (14) is placed on a magnesium disk (10) which is supported by one or more arms (16). When the bone conduction vibrator is turned on, force is transferred through a piston block (22) and measured by an accelerometer (50). Damping of the disk (10) so as to simulate the skin, is provided by an air space between the disk and the piston (30).

Additional research was performed and mechanical impedance values for an idealized average cranial bone (either mastoid or other) were created by the International Organization for Standardization prior to 1970, and were incorporated into the ANSI S3.13-1972 (R-1977), American National Standard for an Artificial Headbone for the Calibration of Audiometer Bone Vibrators and into IEC Publication 373 (1971). An approximate equivalent circuit for the artificial idealized headbone is shown in FIG. 1C, wherein m is a mass of $0.77\times10^{-3}$ kg, r is 19.3 $Nsm^{-}$, and k is $2.25\times10^{5}$ $Nm^{-1}$. The goal of the equivalent circuit was to provide a testing device which could replicate the impedance of an average headbone as shown in Table I.

TABLE I

| Frequency (Hz) | Mechanical reactance $Nsm^{-1}$ | Mechanical resistance $Nsm^{-1}$ | Mechanical impedance $Nsm^{-1}$ |
|---|---|---|---|
| 125 | −290.0 | 74 | 299 |
| 160 | −220.0 | 55 | 227 |
| 200 | −180.0 | 44 | 185 |
| 250 | −140.0 | 36 | 145 |
| 315 | −110.0 | 29 | 114 |
| 400 | −89.0 | 25 | 92 |
| 500 | −71.0 | 22 | 74 |
| 630 | −55.0 | 20 | 59 |
| 800 | −42.0 | 19 | 46 |
| 1000 | −32.0 | 18 | 37 |
| 1250 | −23.0 | 17 | 29 |
| 1500 | −17.0 | 17 | 24 |
| 1600 | −15.0 | 17 | 23 |
| 2000 | −8.4 | 17 | 19 |
| 2500 | −2.2 | 18 | 18 |
| 3000 | +2.7 | 18 | 18 |
| 3150 | +3.9 | 18 | 18 |
| 4000 | +10.0 | 19 | 21 |
| 5000 | +17.0 | 21 | 27 |
| 6000 | +22.0 | 23 | 32 |

The above table was modified into a decibel based system in accordance with the ANSI S3.13 (R-1987), American National Standard for an Artificial Headbone for the Calibration of Audiometer Bone Vibrators and into IEC Publication 373 (1990) shown in Table II.

TABLE II

| Frequency (Hz) | Mechanical impedance level dB re 1 $Nsm^{-1}$ |
|---|---|
| 125 | 48.9 |
| 160 | 47.4 |
| 200 | 45.8 |
| 250 | 44.3 |
| 315 | 42.9 |
| 400 | 41.3 |
| 500 | 39.9 |
| 630 | 38.5 |
| 800 | 37.0 |
| 1000 | 35.5 |
| 1250 | 34.0 |
| 1600 | 31.9 |
| 2000 | 29.8 |
| 2500 | 27.8 |
| 3150 | 27.3 |
| 4000 | 29.5 |

TABLE II-continued

| Frequency (Hz) | Mechanical impedance level dB re 1 $Nsm^{-1}$ |
|---|---|
| 5000 | 32.6 |
| 6300 | 34.6 |
| 8000 | 35.1 |

In ANSI S3.26-1981, it was noted that no commercial product had become available that matches the impedance values within close tolerances, and that some of the devices attempting to match the values were inconsistent. Because no testing apparatus was available that met the standard, an appendix to ANSI S3.26-1981 set forth a type 4930 artificial mastoid as being the testing apparatus of choice, apparently because it was the most accurate device available. A partial cross-sectional view is shown in FIG. 1D. The device includes a loading mass (60) which is sandwiched between a butyl rubber cover (62), and a neoprene disk (64). The two rest on a domed base (66) which is in turn positioned above guide pins (68), ceramic disks (70) and a central electrode (72) which is connected to an output (74). An inertial mass (76) is also provided.

This design was incorporated also in ANSI S3.13-1987. The prior art used B71 bone vibrators which had a curved surface and the specified design had a spherical surface that matched the bone vibrator. However, the most recent standard, ANSI S3.13-1987, specifies that the bone vibrator have a flat surface, while the design specified for the artificial mastoid still has a spherical surfaces (62 in FIG. 1D). Measurements have shown that the poor match between the flat bone vibrator and the rounded artificial mastoid can cause unacceptable variations between successive tests, particularly at high frequencies.

ANSI S3.13-1987 also requires a linear temperature correction factor which, in practice, is not supplied by the manufacturer. Recent work has shown that the temperature correction is significant and that the correction is not linear. Also, ANSI S3.13-1987 does not require a waiting period for the device to reach ambient temperature in the testing room. Measurements have shown that, for large temperature differences between the room and outdoors, the period for temperature equalization between the prior art device and room temperature can be more than 12 hours. These factors severely restrict the portability of the prior art artificial mastoid.

Those skilled in the art will be familiar with the prior art artificial mastoid. The device is relatively expensive and is difficult to calibrate. In order to ensure an accurate result, numerous springs must be adjusted. Because of these factors, many hearing specialists do not purchase a device for conducting tests on bone conduction hearing devices. Rather, they simply purchase an artificial ear, a device for calibrating earphones used in hearing tests, and forego the benefits of a device for testing bone conduction hearing devices.

A side cross-sectional view of one type of artificial ear is shown in FIG. 1E. The artificial ear is made to internationally accepted specifications, ANSI S3.7-1995 and includes a generally cylindrical housing (80) with an opening (82) at one end. A small vent hole (84) is provided in the housing, along with a hole (86) for receiving the chord of a precision microphone (88). The volume of a void (90) between the opening (82) and the microphone (88) is six cubic centimeters, the average volume of air in a human ear.

A side cross-sectional view of another type of artificial ear is shown in FIG. 1F. This artificial ear is made in accordance with national, ANSI S3.7-1955, and international, IEC 318-1970, standards. The device includes a cylindrical housing (92) with an opening (92*a*) at one end. The device also contains at least one small vent hole 94 and two internal cavities (96 and 98). The volume of the void 100 between the opening 92*a*) and the microphone (102) is two cubic centimeters. This type of artificial ear is used widely outside the United States.

Because of the wide spread availability of the two types of artificial ear; and the fact that they are considerably less expensive than the prior art artificial mastoids, it would be beneficial to find an apparatus and method which would allow an artificial ear to be used to test bone conduction hearing devices. Additionally, it would be beneficial if the apparatus and method were as accurate, or more accurate in representing the impedance of a human mastoid than the devices of the prior art.

OBJECTS AND SUMMARY OF THE INVENTION

It is an object of the present invention to provide an apparatus and method for testing bone conduction hearing devices.

It is another object of the present invention to provide such an apparatus and method which is less expensive than currently available testing devices.

It is another object of the present invention to provide such an apparatus and method which are more accurate than the testing devices which are presently available.

It is yet another object of the present invention to provide such an apparatus and method which are easier to use than the testing devices which are presently available.

It is still another object of the present invention to provide an artificial mastoid with a flat testing surface to improve mating between the artificial mastoid and the bone vibrator.

It is still yet another object of the present invention to provide a sensing mechanism for detecting the artificial mastoid's temperature and which can automatically correct the data generated to compensate for any difference between the artificial mastoid and the temperature provided for in the standard.

Still another object of the present invention is to provide an apparatus that may be used on a multiplicity of artificial ears, thereby decreasing costs increasing portability and facilitating wide use within the industry.

The above and other objects of the invention are realized in specific illustrated embodiments of an apparatus and method for simulating a human mastoid. The apparatus for simulating a human mastoid includes a diaphragm having a mechanical impedance representative of an average human mastoid, as shown in Table I or Table II.

In accordance with one aspect of the present invention, the diaphragm has a central section and a peripheral flange extending from the central section which are configured in shape and composition to supply a desired reactance and resistance to vibratory force, such as the force which is generated by a bone conduction transducer, based on mass and stiffness of the diaphragm, thereby simulating impedance of a human mastoid bone.

In accordance with another aspect of the invention, the diaphragm is formed from a combination of metal and resilient polymers to impart characteristics to the artificial mastoid which closely resemble the characteristics of an average human mastoid.

In a preferred embodiment, the method includes placing the diaphragm over the opening in an artificial ear, and placing the bone conduction transducer on the opposite side of the diaphragm. A weight creating a force of 5.4N is placed against the bone conduction transducer to simulate a bone conduction hearing device in actual use. The bone conduction transducer is tested through select frequencies, as shown in Table I or Table II, to test the transducer. Readings obtained by the microphone in the artificial ear gives more accurate readings than had been available prior to the present invention, and does so by making use of an artificial ear; devices which are owned by nearly all audiologists.

In accordance with another aspect of the invention, the impedance of the simulated mastoid may be monitored in other ways, such as by the use of a laser and/or a position sensor, to determine the effectiveness of the bone conduction transducer.

In accordance with another aspect of the invention, a device other than an artificial ear may be used with the diaphragm to determine the effectiveness of a bone conduction transducer.

In accordance with still yet another aspect of the present invention, a sensing device is affixed to the artificial mastoid for determining mastoid temperature. The data regarding temperature are processed and correlated with the readings received by testing the bone vibrator to provide a series of correction factors which compensate for differences between the artificial mastoid's temperature and the temperature upon which the standard is based.

Still yet another aspect of the invention includes the use of an artificial mastoid which is configured to nest on the artificial ear during testing so that support members are not required to hold the mastoid in place.

BRIEF DESCRIPTION OF THE DRAWINGS

The above and other objects, features and advantages of the invention will become apparent from a consideration of the following detailed description presented in connection with the accompanying drawings in which:

FIG. 11A shows a correction chart for adjusting the readings obtained for a variety of temperatures and frequencies; and FIG. 11B shows a correction chart for adjusting the readings obtained responsive to environmental humidity.

DETAILED DESCRIPTION

Figure 2:
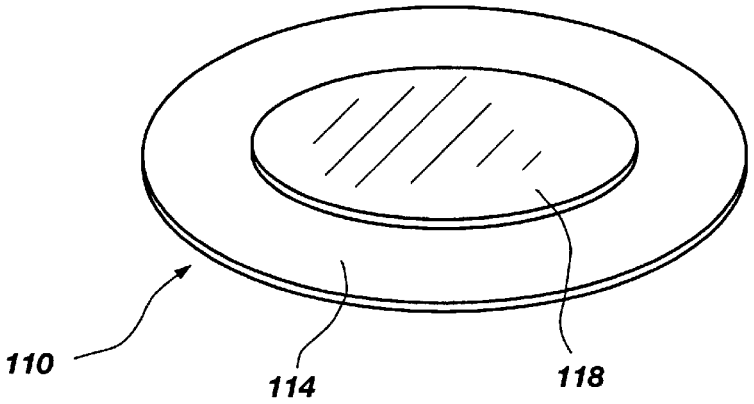
FIG. 2 shows a perspective view of a diaphragm made in accordance with the principles of the present invention.
Figure 1F:
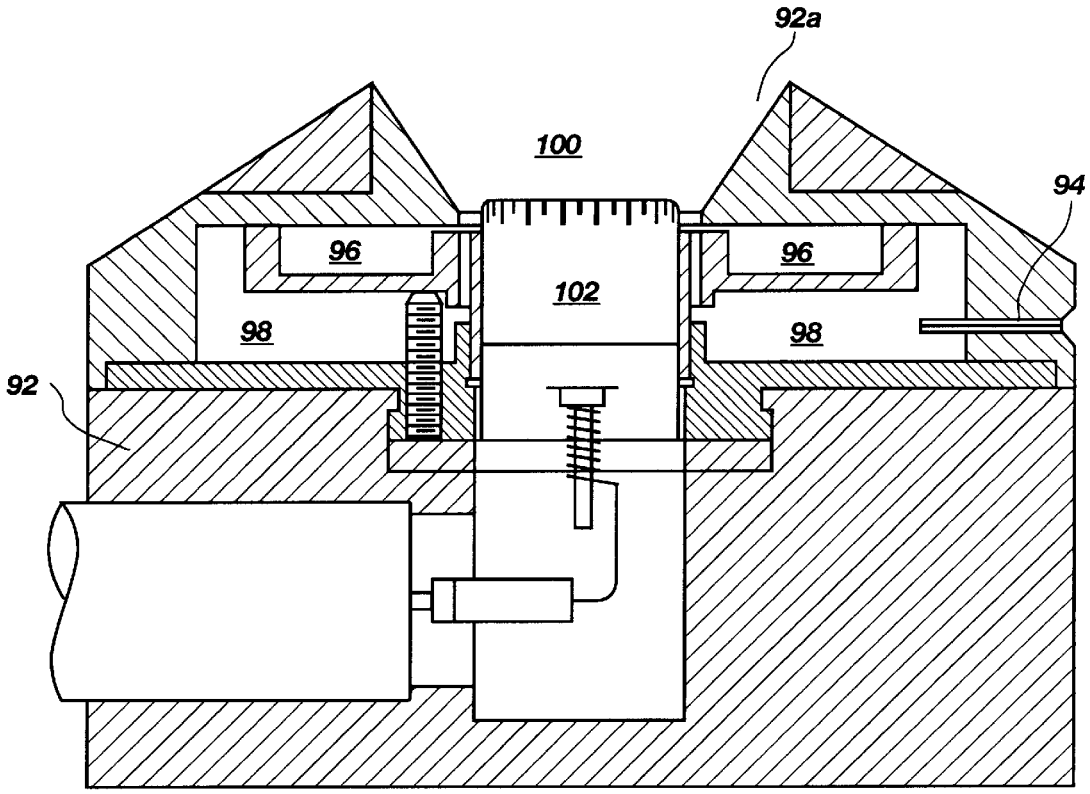
Fig. 1F (PRIOR ART)
FIG. 1F shows another prior art artificial ear which is typically used to calibrate earphone used for testing hearing loss, and which may be used with the artificial human mastoid of the present invention to calibrate a bone conduction hearing device.

Reference will now be made to the drawings in which the various elements of the present invention will be given numeral designations and in which the invention will be discussed so as to enable one skilled in the art to make and use the invention. Referring to FIG. 2, there is shown a diaphragm, generally indicated at 110. The diaphragm 110 consists of a stiffening plate 114, and a damping layer 118 which is preferably adhesively attached to the stiffening plate.

Figure 5:
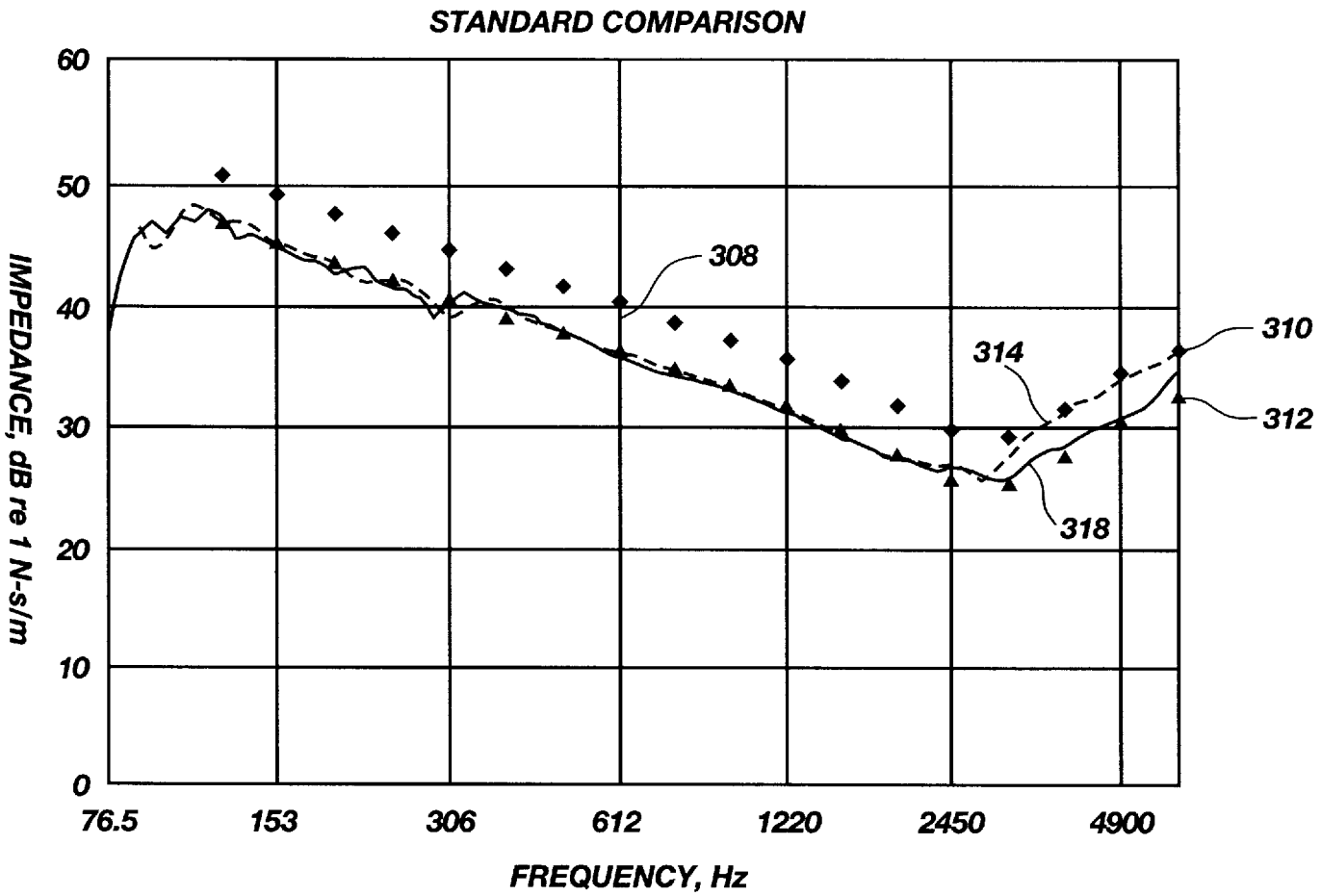
FIG. 5 shows an graph demonstrating an ideal response for an artificial mastoid in accordance with the American National Standard, as well as actual responses from the embodiment of the present invention shown in FIG. 3.

In order to properly simulate a human mastoid and the skin which overlies the mastoid, the test device must include springiness, damping and mass in interrelation to achieve impedance (reactance and resistance) which corresponds to that present in the average human as shown in Tables I and II. The substance the test device is made from is not of major importance. Rather, what is important is that the device have impedance properties which conform to the standards determined by scientific study. Namely, the mass, springiness and damping must integrate to provide an impedance (reactance and resistance) similar to the average mastoid. A graph providing an ideal response range and those provided by one embodiment of the present invention and the prior art are shown in FIG. 5, and will be discussed in additional detail below.

Typically, the stiffening plate 114 of the diaphragm will be made of metal, such as aluminum, and the damping layer will be made of a synthetic rubber-like material having a known density, such as neoprene. However, in light of the present disclosure, those skilled in the art will recognize that the material of the diaphragm is not important, as long as the stiffening plate 114 and the damping layer 118 have the proper springiness, mass, and damping characteristics. As will be discussed below, the stiffening plate 114 and the damping layer 118 could even be formed of a single material, such as a composite.

In the embodiment shown in FIG. 2, the stiffening plate 114 is an aluminum disk having a mass of between about 0.5 and 1 gram, and preferably about 0.77 grams. The shape of the stiffening plate is not important, so long as the components of impedance are met. Suitable materials from which the stiffening plate may be made include, for example, magnesium, graphite composite, plastic, beryllium, stainless steel, MONEL, and aluminum.

Likewise, the damping layer has a mass of 0.1 gram to 3 grams, and is generally disk shaped, but could be other shapes as well. Materials from which the damping layer may be made include, but are not limited to neoprene rubber, butyl rubber, polyurethane, vinyl, and other visco-elastic polymers (either foamed or not foamed).

Typically, the stiffening plate 114 has a diameter of between about 1.5 and 3 inches, and a thickness of between about 0.05 and 0.3 inches. The damping layer 118 has a smaller diameter, typically, less than 1 inch. Obviously, the diaphragm need not be of uniform thickness as long as its springiness, mass and damping are in appropriate relationship to one another to achieve an impedance similar to that specified in the accepted standards. In fact, as will be discussed below, in a preferred embodiment, the stiffening plate is not of a uniform thickness.

Figure 3:
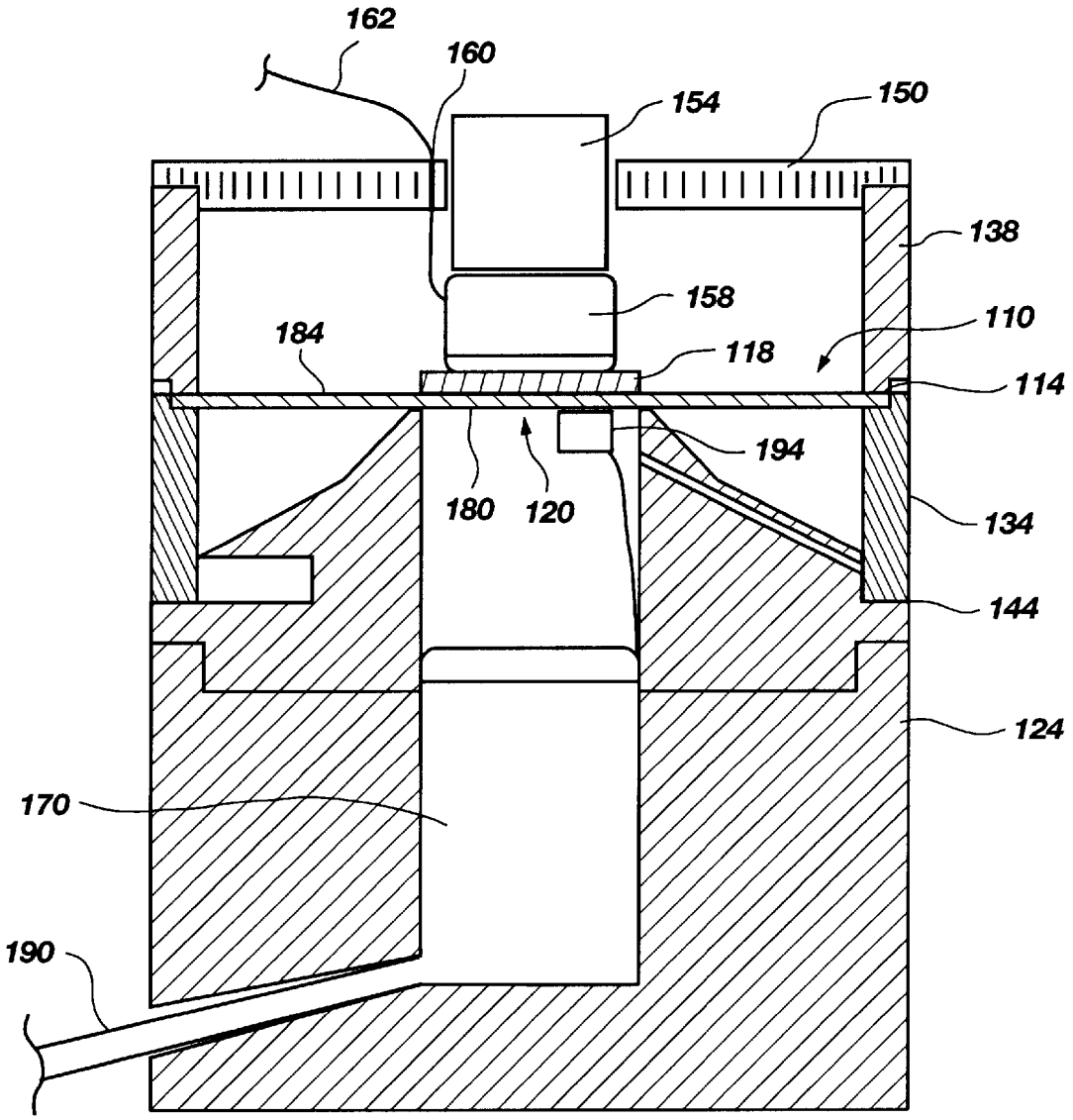
FIG. 3 shows a side cross-sectional view of the diaphragm of FIG. 2 disposed on a conventional artificial ear, as shown in FIG. 1E, and a plurality of support members for holding the diaphragm in place adjacent the artificial ear.

Referring now to FIG. 3, there is shown a cross-sectional view of a diaphragm disposed on a conventional artificial ear, and a plurality of support members for holding the diaphragm in place adjacent the artificial ear. Specifically, the diaphragm 110 is positioned so that the stiffening plate 114 rests on an opening 120 in the artificial ear 124.

As shown in FIG. 3, the stiffening plate 114 is supported by a pair of holding rings 134 and 138. The lower ring 134 nests on the annular ridge 144 of the artificial ear 124 and rests against the bottom of the stiffening plate 114. An upper ring 138 extends upwardly from the stiffening plate 114 and supports a weight restraining plate 150. As the name implies, the weight restraining plate 150 has a hole formed therein for holding a weight 154. In accordance with accepted standards, the weight 154 is typically a 5.4N weight which rests atop a bone conduction transducer 158 and holds it in firm contact with the damping layer 118 of the diaphragm 110. The weight restraining plate 150 may also have a small wire cut 160 to facilitate placement of a power cord 162 for the bone conduction transducer 158.

In use, the bone conduction transducer 158 is activated to vibrate in a conventional fashion. The vibrations generated by the bone conduction transducer 158 are conveyed through the diaphragm 110 and result in sound being conveyed to a microphone 170 positioned in the artificial ear 124. As the vibrations pass through the mass of the diaphragm 110, the damping layer 118 damps the vibrations, and the springiness component of impedance is obtained by the hinge like interaction between a central section 180 of the stiffening plate 114, and an peripheral outer section 184 of the stiffening plate. In light of this disclosure, and other information generally know, those skilled in the art will appreciate that this interaction depends on the mass of the central section 180, the thickness of the peripheral outer section 184, as well as the stiffness of the material from which the stiffening plate 114 is made.

The sounds received by the microphone 170 are converted into an electrical impulse and sent via a cable 190 to a recording instrument. By measuring the sound, i.e. the displacement of the central section 180, the microphone 170 indicates the effectiveness of the bone conduction transducer 158. The arrangement shown is not only at least as accurate as the testing devices of the prior art, it is also much easier to use, and is considerably less expensive. Most audiologists own an artificial ear 124, and the cost of a new one is about one-quarter that of the prior art testing devices. Within a matter of seconds, the artificial ear 124 can be converted into an artificial mastoid and can be used to test bone conduction hearing devices with accuracy as good as or better than the more expensive prior art device.

While the microphone 170 is the preferred method for measuring the vibrations which pass through the impedance provided by the diaphragm 110, an accelerometer 194 could also be used to determine vibratory force. In fact, any method of measurement which is able to determine the vibrations of the diaphragm 110 may be used to determine whether the bone conduction transducer 158 is functioning properly.

Thus, with the embodiment shown in FIG. 3, an accurate result is obtained concerning the bone conduction transducer 158. Additionally, because of the ease of the testing method and the decreased cost, more audiologists will be able to test bone conduction hearing devices for their patients.

Figure 4:
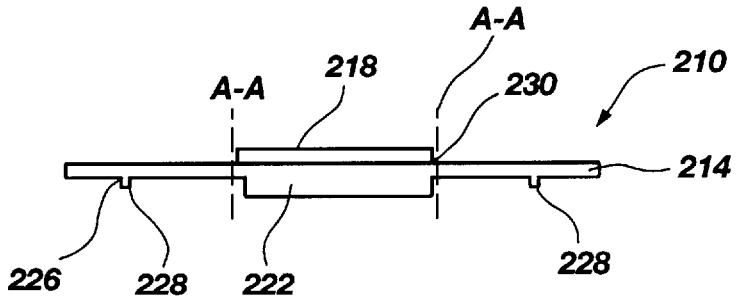
FIG. 4 shows a side cross-sectional view of another diaphragm made in accordance with the principles of the present invention.

Referring now to FIG. 4, there is shown a side cross-sectional view of another embodiment of a diaphragm made in accordance with the principles of the present invention. Specifically, the diaphragm, generally indicated at 210, includes a stiffening plate 214 and a damping layer 218. The stiffening plate 214 is made of aluminum and has a mass of slightly more than 0.8 grams. As may be observed from FIG. 4, the majority of the mass (approximately 0.77 grams) is disposed in a central section 222, which is about 1.3 inches in diameter and about 0.06 inches thick. A thin peripheral flange 226 extends radially outwardly from the central section 222 for about 0.45 inches. The peripheral flange section 226 is about 0.02 inches thick. An annular flange 228 about 0.02 inches thick may extend downwardly from the peripheral flange 226 about 0.28 inches from the central section 222. While the portions of the peripheral flange 226 may of the same thickness on both sides of the annular flange 228, they may also be thinner inside of the annular flange, i.e. 0.01 inches, or thicker, i.e. 0.03–0.05. As will be appreciated in light of the present disclosure, changing the thickness will alter the springiness provided by the peripheral flange 226.

The damping layer 218 is attached to the stiffening plate 214 by an adhesive material 230 and is made of a synthetic rubber-like material, such as silicone rubber, having a consistent and known density. Typically, the damping layer will be about 0.05 inches thick and about 1 inch in diameter.

When using the embodiment shown in FIG. 4, the diaphragm 210 is set upon an artificial ear (shown in FIG. 3) so that the central section 222 nests within the opening 120 (FIG. 3) and so that the peripheral flange 226 rests on the end of artificial ear forming the opening. In order to properly simulate the impedance of a human mastoid and the skin covering the mastoid, a testing device must provide damping, springiness and mass representative of the human mastoid. When a bone conduction transducer is applied to the damping layer, damping is provided by the damping layer 218. Springiness is provided by the peripheral flange 226 and its interaction between the central section 222.

Specifically, the peripheral flange 226 forms a concentric hinge about the central section 222 along the lines A—A. The mass necessary is provided by the diaphragm 210, and, in particular, the central section 222.

Those skilled in the art will recognize that the defined mass, dimensions, etc., are appropriate for a diaphragm made from the specified materials. If other materials are used, or if any of the dimensions are changed, adjustments must be made to compensate for differing densities, as well as differences in springiness and damping ability. Those skilled in the art will be able to determine the exact dimensions for other materials which may be used without excessive experimentation by comparing impedance results obtained to the idealized curve, shown in FIG. 5, representing the ideal simulated mastoid.

One major advantage of the embodiment shown in FIG. 4 is that the increased thickness of the central section 222 causes that section to nest in the opening of the artificial ear (FIG. 3). Because the central section 222 nests within the opening, lateral movement of the diaphragm 210 is significantly reduced.

Figure 1A:
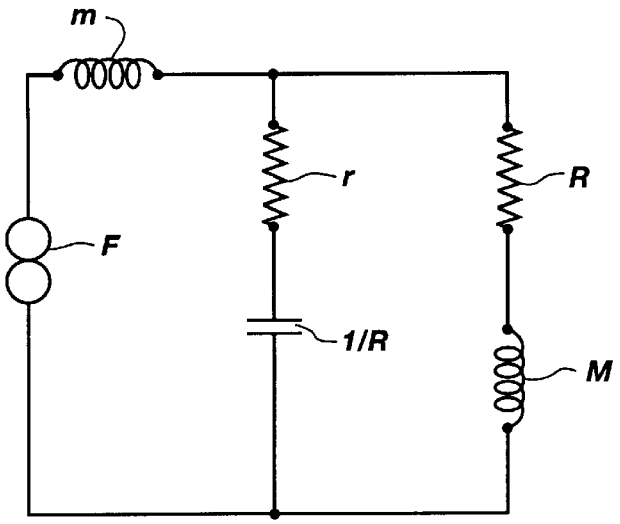
Fig. 1A (PRIOR ART)
FIG. 1A shows an electrical equivalent circuit diagram of an apparatus for testing a bone conduction hearing device in accordance with the teachings of the prior art.
Figure 1B:
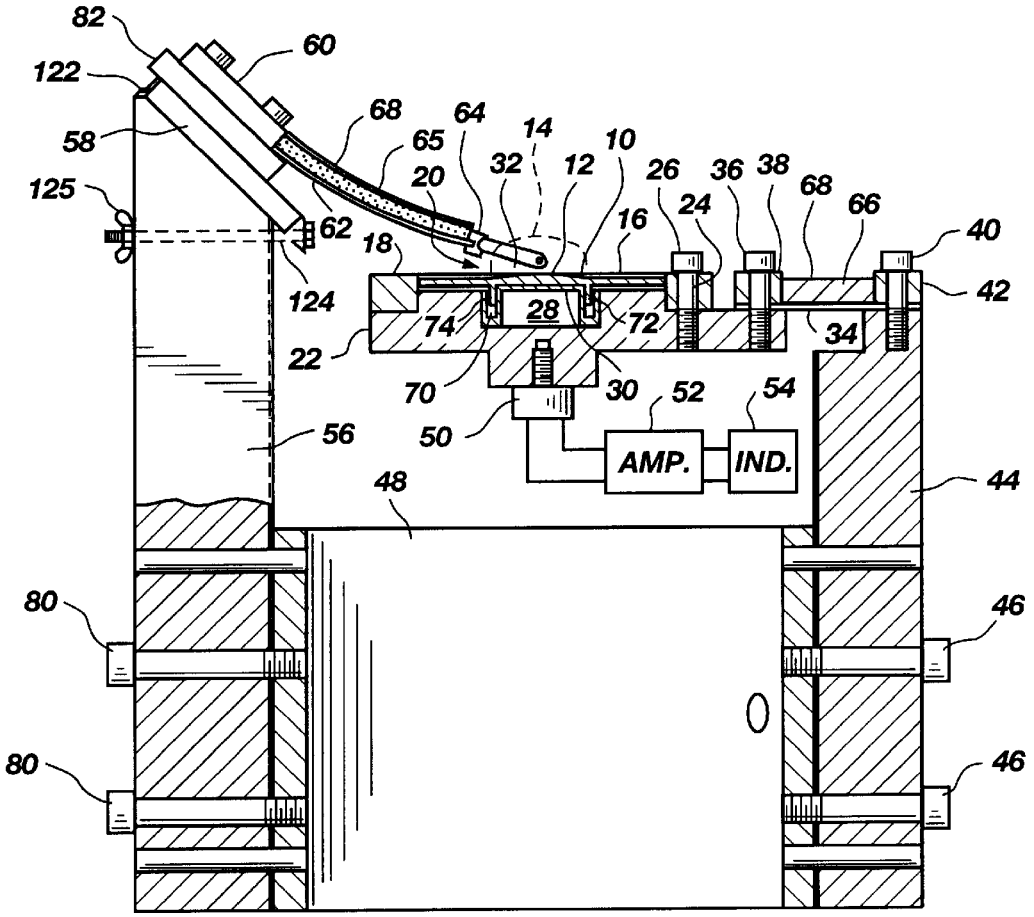
Fig. 1B (PRIOR ART)
FIG. 1B shows a side cross-sectional view of a prior art device for testing bone conduction hearing devices.
Figure 1C:
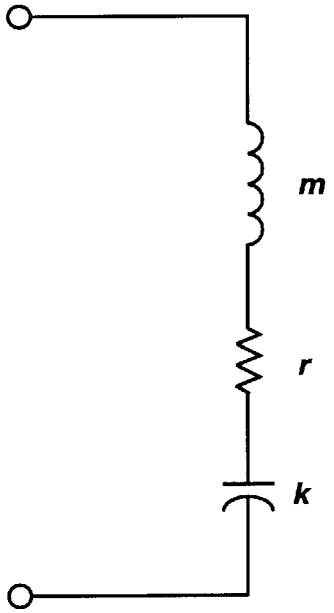
Fig. 1C (PRIOR ART)
FIG. 1C shows an approximate equivalent circuit for the American National Standard for an artificial headbone for calibrating bone conduction hearing devices.
Figure 1D:
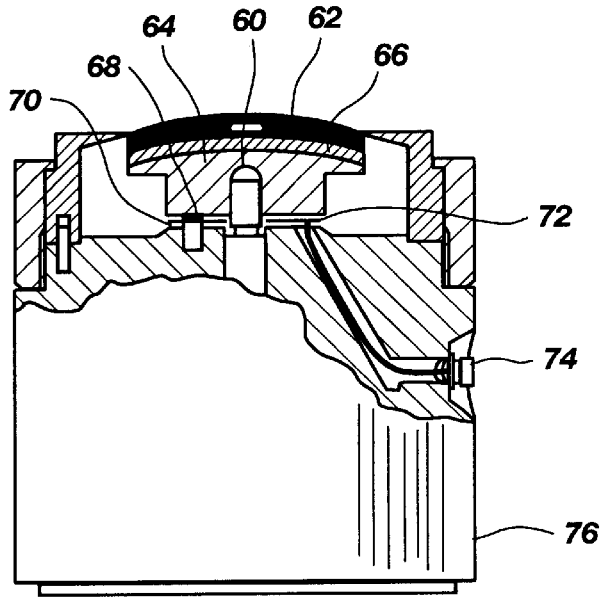
Fig. 1D (PRIOR ART)
FIG. 1D shows a side, partial cross-sectional view of another prior art device for testing bone conduction hearing devices.

Referring now to FIG. 5, there is shown a graph representing the ideal curve range 308 representing the standard discussed above with respect to Table I, the upper end of the range being shown at 310 and the lower end of the range at 312. A curve representing a test response of the prior art device shown in FIG. 1D is shown at 314. Also shown is a curve 318 representing the readings obtained during a test of the embodiment discussed in FIG. 4. As can be seen, the embodiment discussed in FIG. 4 provides an equally accurate representation of the ideal curve 310, and therefore, an equally accurate representation of an average human mastoid. Thus, when used to test bone conduction hearing devices, the present invention provides increased convenience and similar accuracy, while drastically reducing the cost.

While the embodiment shown in FIG. 4 is equally accurate to the prior art device shown in FIG. 1D under generally ideal conditions, it becomes significantly more accurate as temperatures change. The readings shown in FIG. 5 are for tests conducted at 23° C. However, as one moves away from that temperature in either direction, the accuracy of the prior art devices and this device decrease significantly and must be corrected. Those skilled in the art will understand that such differences are significant, as the prior art devices can take hours to equalize to the temperature of a room. This is especially important in that many laboratories contract with a testing services which travel between laboratories and cannot wait hours for the testing equipment to equalize to the desired temperature.

In contrast, the diaphragm of the present invention can equalize to room temperature within a matter of minutes, and may even be used accurately at temperatures significantly above and below the temperature stated above.

Figure 6:
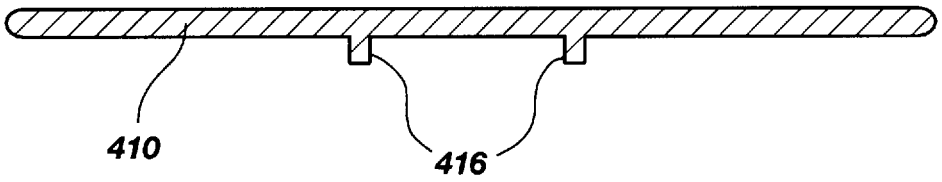
FIG. 6 shows yet another cross-sectional view of a diaphragm made in accordance with the principles of the present invention.

Referring now to FIG. 6, there is shown another embodiment of the present invention. Rather than providing a diaphragm, as in FIGS. 2 and 4, which has a synthetic damping layer and a metallic stiffening plate, the present embodiment is a diaphragm comprising a single composite disk 410. The disk 410 is formed so that it incorporates the springiness, damping and mass necessary to replicate the impedance of a human mastoid. Obviously, the exact dimensions of the disk will be dependent on the type of composite used, whether that material is graphite or some other composite. Additionally, the significant growth in development of new composites will likely provide several which are suitable for a diaphragm as described herein.

Figure 1E:
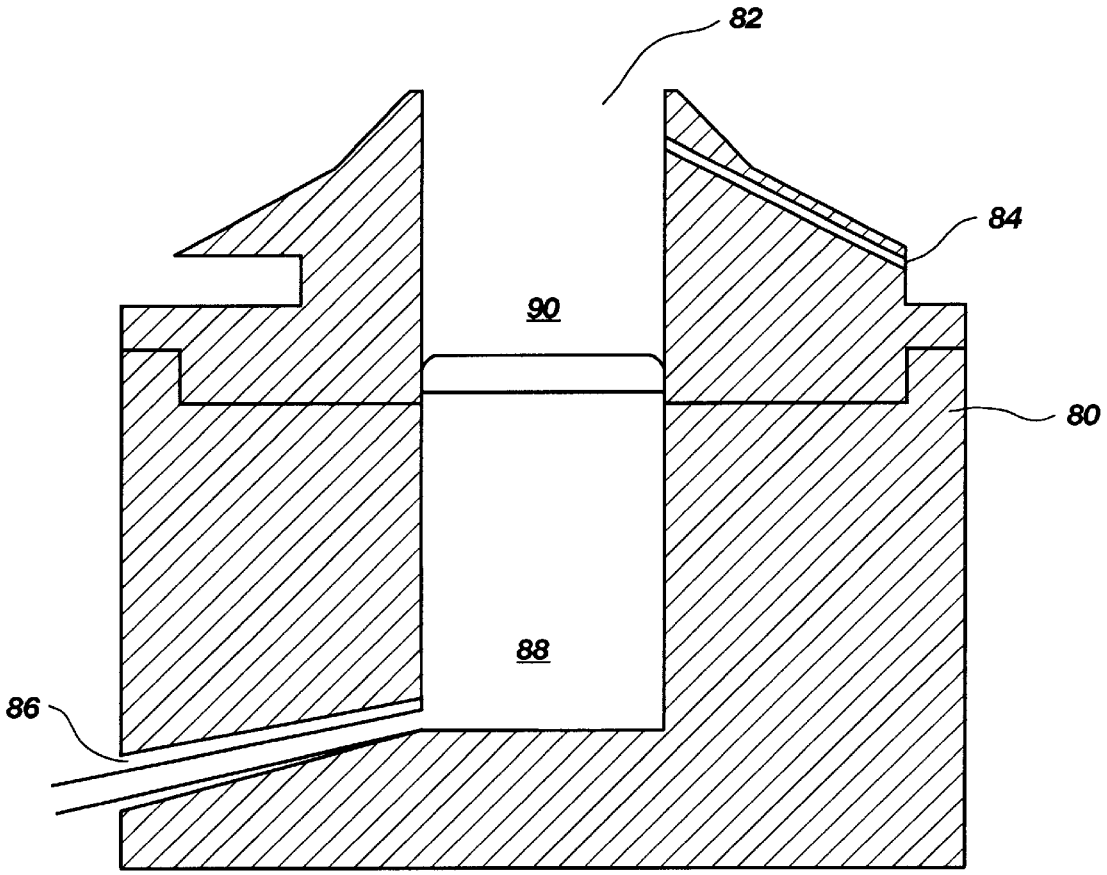
Fig. 1E (PRIOR ART)
FIG. 1E shows a prior art artificial ear which is typically used to calibrate earphones used to test for hearing loss, and which may be used with the simulated human mastoid of the present invention to calibrate a bone conduction hearing device.

The disk 410 also includes an annular flange 416 which extends downwardly. When used with an artificial ear, such as those described regarding FIGS. 1E and 3, the flange 416 nests inside of the opening, so as to minimize lateral movement of the disk 410.

Figure 7:
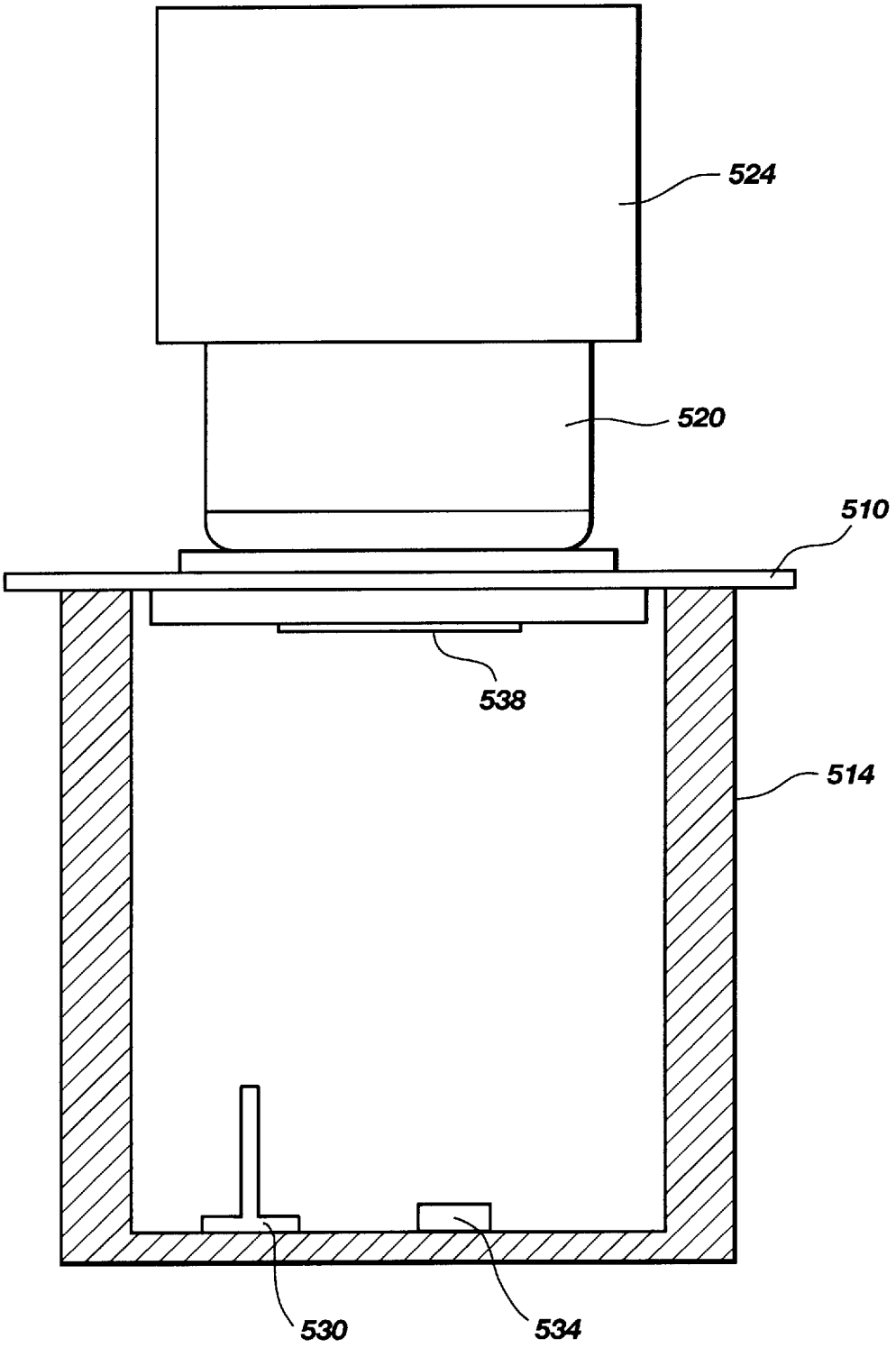
FIG. 7 shows an alternate method for practicing the present invention.

Referring now to FIG. 7, there is shown a side cross-sectional view of an alternate embodiment for practicing the present invention. Instead of resting upon a closed air column, as shown in FIG. 3, a diaphragm 510 rests upon a generally open base 514. A bone conduction transducer 520 rests atop the diaphragm 510, and is held against the diaphragm by a 5.4N weight 524. As with the embodiments previously discussed, in order to determine the effectiveness of the bone conduction transducer 520, the vibrational movement of the diaphragm 510 must be monitored. This is accomplished by providing a laser interferometer 530 which is positioned below the diaphragm 510, along with a position sensor 534. A reflective surface 538 is placed on the underside of the diaphragm 510, and the magnitude of the vibrations caused by the bone conduction transducer 520 is monitored by the sensor 534 as it measures the changing times between emission of the laser from the interferometer 530 and receipt by the sensor. Those skilled in the art will recognize that the readings from the sensor may then be used to determine the effectiveness of the bone conduction transducer 520 in overcoming the impedance of an average human mastoid, as represented by the diaphragm 510.

As will be appreciated by those skilled in the art, the present embodiment does not require an enclosed column of air as is provided by the artificial ear in FIG. 3. Rather, the base 514 need merely support the diaphragm 510 above the laser interferometer 530 and the sensor 534. The shape of the base 514 is relatively unimportant.

Figure 8:
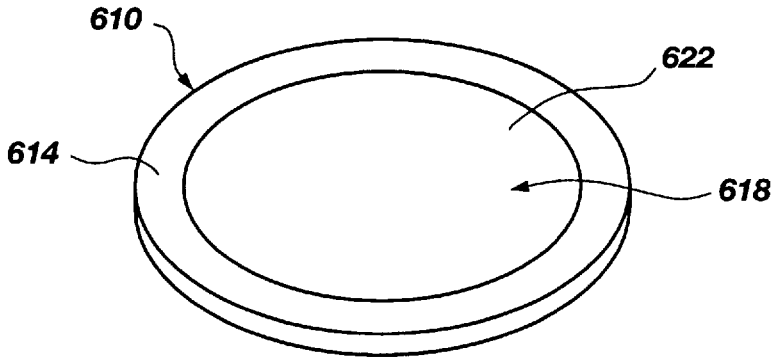
FIG. 8 shows perspective view of an alternate diaphragm made in accordance with the teachings of the present invention.

Referring now to FIGS. 8, there is shown a perspective view of yet another embodiment of the present invention. Based on experimentation, it is currently believed that the embodiment shown in FIG. 8 is a preferred embodiment for practicing the principles of the present invention.

The diaphragm 610 includes a stiffening plate 614. Typically, the stiffening plate 114 of the diaphragm 110 will be made of metal, such as aluminum.

The stiffening plate 614 is formed to receive a first damping portion 618 in an upper side thereof, and a second damping portion (FIG. 8A) in a lower side thereof. The first damping portion 618 will typically be made of several layers of material which are discussed in detail below. In a preferred embodiment, the stiffening plate 614 is approximately 1.18 inches in diameter, and the overall thickness of the stiffening plate is about 0.280 inches. When made of aluminum, the weight of the stiffening plate 614 is about 0.0082 pounds.

Nested in a void formed in the stiffening plate 614 is the first damping portion 618. The damping portion has a diameter of about 0.86 inches and a total thickness of about 0.128 inches. When configured as described in FIG. 8A, the first portion has a weight of about 0.0038 pounds.

Figure 8A:
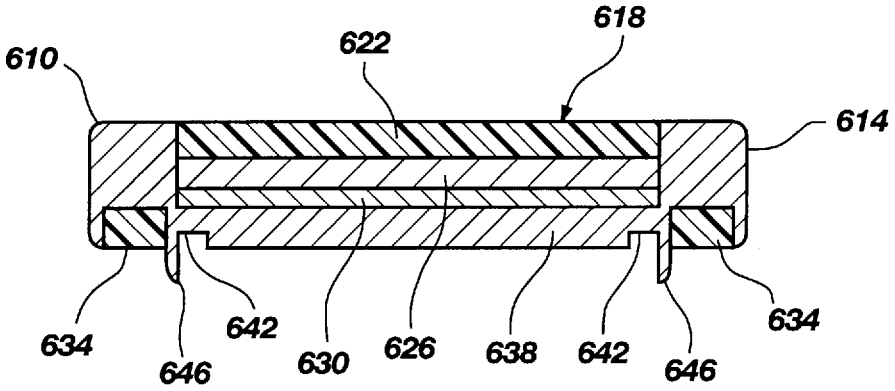
FIG. 8A shows a side cross-sectional view of the diaphragm shown in FIG. 8.

Referring now to FIG. 8A, there is shown a cross-sectional view of the diaphragm 610 shown in FIG. 8. The first damping portion 618 is typically multi-layered. In a preferred embodiment, the first damping portion 618 includes a first layer 622 of a visco-elastic material, such a the material sold by E-A-R Corporation as item C1002-06. The first layer is about 0.860 inches in diameter and 0.060 inches thick, and weighs approximately 0.0017 pounds.

A second layer 626 disposed below the first layer 622 is formed from brass or steel. When formed from brass, the second layer 626 is about 0.830 inches in diameter, 0.012 inches thick, and weighs about 0.0016 pounds.

A third layer 630 is disposed below the second layer 626. The third layer 630 is typically made of a visco-elastic foam, such as that sold by the 3M corporation as item number 4516. The foam of the third layer 630 is preferably about 0.860 inches in diameter, approximately 0.056 inches thick, and weighs about 0.0005 pounds.

Also shown in FIG. 8A is the second damping portion 634 positioned in an annular groove in the stiffening plate 614. The second damping portion 634 is preferably formed from a ring of visco-elastic polymer formed from the same material as the first layer 622 of the first damping portion. The second damping portion 634 is about 1.15 inches in diameter, is approximately 0.060 inches thick, and weighs approximately 0.0010 pounds. The second damping layer 634 provides a desirable contact surface for engaging the walls forming the large opening in an artificial ear. However, those skilled in the art will appreciate that the second damping layer could be omitted. Of course, such an omission would require modifications to each of the other portions of the diaphragm to achieve the desired performance characteristics.

The second damping portion 634 encircles a bottom sidewall 638 of the stiffening plate 614 on which the first damping portion 618 rests. To obtain the desired characteristics, the bottom sidewall 638 of the stiffening plate 614 may include an annular groove 642 so that the bottom sidewall is approximately 0.060 inches thick in the center, but only about 0.40 inches thick about its perimeter.

Extending down from the bottom wall 638 is a circular flange 646. As with the flange 416 discussed above, the flange 646 nests the diaphragm 610 partially within the artificial ear and helps to limit lateral movement of the diaphragm during testing.

Figure 9:
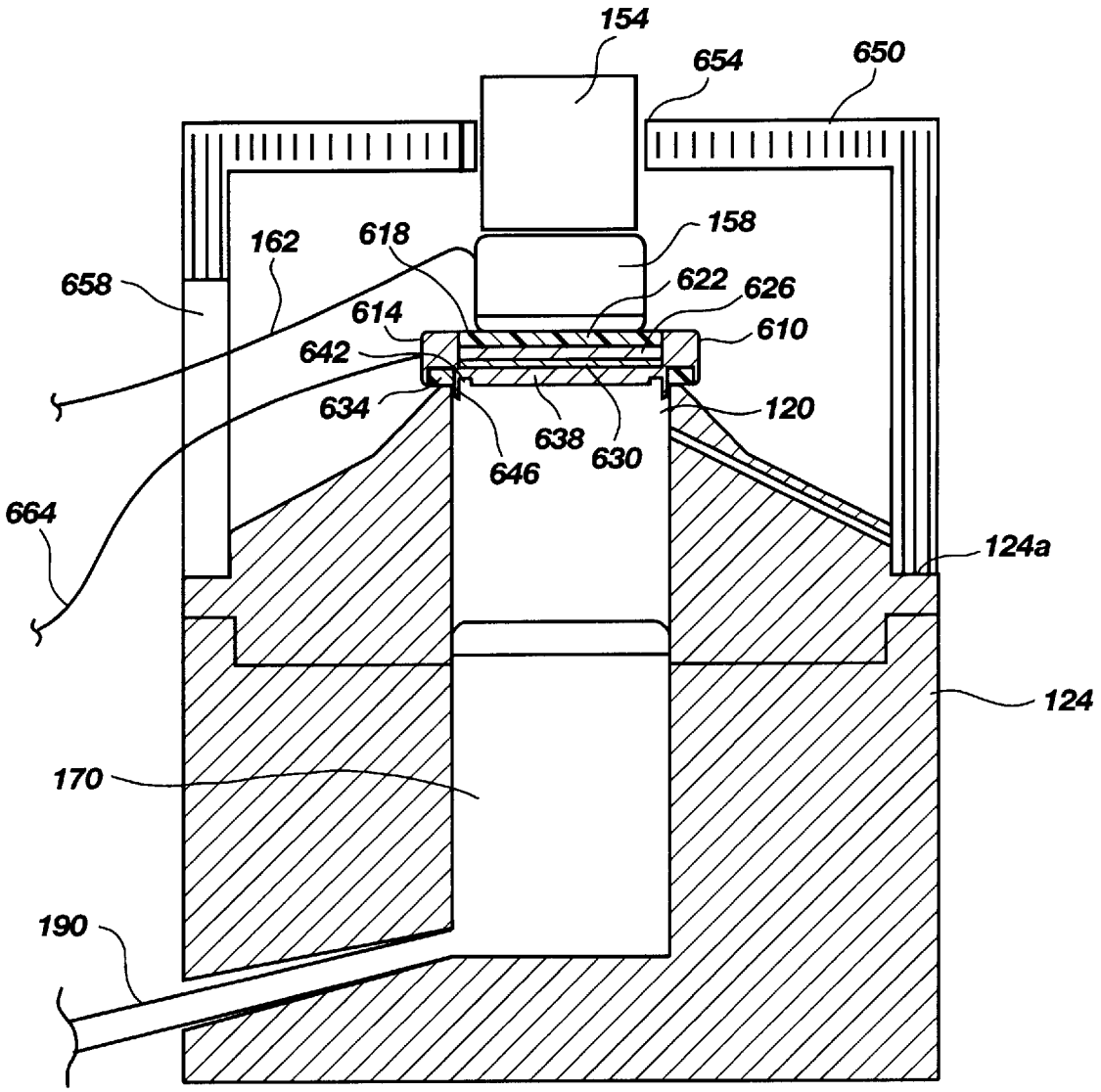
FIG. 9 shows a side cross-sectional view of the diaphragm of FIG. 8 disposed on a conventional artificial ear, as shown in FIG. 1E, and a support member for holding a bone conduction transducer adjacent the diaphragm while the diaphragm is in place on the artificial ear.

Referring now to FIG. 9, there is shown a cross-sectional view of the diaphragm 610 shown in FIG. 8 disposed on top of an artificial ear 124. Specifically, the diaphragm 610 is positioned so that the flange 646 of the stiffening plate 614 rests within the opening 120, and so that the weight of the diaphragm is supported by the second damping portion 634.

A retaining ring or housing 650 is provided for positioning the weight over the artificial ear 124 and stabilizing it. Preferably, the housing 650 rests on the ledge 124*a* formed in the artificial ear 124, although this is not required. The housing 650 has a hole 654 formed in a top thereof for holding the weight 154. The weight 154 complies with accepted standards specified in the discussion with respect to FIG. 3, and rests atop a bone conduction transducer 158. The weight 154 holds the bone conduction transducer 158 in firm contact with the first damping portion 618 of the diaphragm 610. The flat face of the bone conduction transducer 158 and the flat surface of the first damping portion 618 prevent undesirable movement of the transducer during testing.

Disposed along one side of the housing 650 is a open channel 658 which facilitates placement of a power cord 162 for the bone conduction transducer 158.

The channel 658 also provides for the passage of a cable 664. In addition to the embodiment shown in FIGS. 8 and 8A, FIG. 9 also shows a temperature sensor means 670, typically a thermistor, which is attached to the diaphragm 610 to monitor the temperature of the diaphragm during testing. Because the temperature of the diaphragm 610 significantly determines performance during testing, the temperature sensor means 670 determines the temperature of the diaphragm when activated by the user. The temperature sensor 670 conveys signals indicative of the temperature to a processor, typically the computer (FIG. 9A), via the cable 664. The software on the computer can then report the temperature of the diaphragm to the user so that he or she can detect any rapid changes in temperature and wait for reasonable equalization of the diaphragm temperature to the temperature at the location of use. In addition, the software can use the signals to automatically choose the proper temperature correction factors from a predetermined correction table accessable by the software. If the temperature changes slightly during the test, it will be corrected for automatically by the computer.

Such a system is in sharp contrast to the prior art. In the prior art, the time to equalize the testing device to room temperature was unknown. Thus, the device was generally kept in a controlled environment with a known temperature. Those skilled in the art will appreciate that this greatly restricts the transportation and use of the device in field testing situations. Also in the prior art, the room temperature was generally unknown, even if constant. Thus, those skilled in the art often ignored temperature correction factors, thereby providing erroneous test results.

The present invention, in contrast, provides a device which is substantially less expensive than the prior art; requires less time to equalize with room temperature; can be used with commonly available equipment; and which provides improved accuracy.

In use, the microphone 170 frequency response and the mastoid frequency response are initially calibrated in accordance with empirically derived values and these values are entered into the software for later use by the processor. The bone conduction transducer 158 is held on the diaphragm and activated to vibrate in a conventional fashion. The vibrations generated by the bone conduction transducer 158 are conveyed through the diaphragm 610 and result in sound being conveyed to the microphone 170 positioned in the artificial ear 124. As the vibrations pass through the mass of the diaphragm 610, the first and second damping layers 618 and 634 damp the vibrations, and the interaction of the respective components provide sufficient springiness, etc. to obtain the desired simulation of a human mastoid. In light of this disclosure, and other information generally know to those skilled in the art will appreciate that this interaction depends on the size and mass of the respective components and any modifications will typically require modifications to other components of the diaphragm 610 to achieve the desired result.

The sounds received by the microphone 170 are converted into an electrical impulse and sent via a cable 190 to the recording instrument 708 and thence to the computer 712. By measuring the sound, the microphone 170 indicates the effectiveness of the bone conduction transducer 158. The readings from the temperature sensor means 670 can be further used to compensate for temperature of the diaphragm 610, thereby providing improved accuracy.

The arrangement shown is not only at least as accurate as the testing devices of the prior art, however, it is also much easier to use, and is considerably less expensive. Most audiologists own an artificial ear 124, and the cost of a new one is substantially less than the prior art testing devices. Within a matter of seconds, the artificial ear 124 can be converted into an artificial mastoid and can be used to test bone conduction hearing devices.

While the microphone 170 is the preferred method for measuring the vibrations which pass through the impedance provided by the diaphragm 610, other measurement devices, such as an accelerometer, could also be used to determine vibratory force. In fact, any method of measurement which is able to determine the vibrations of the diaphragm 610 may be used to determine whether the bone conduction transducer 158 is functioning properly.

Figure 9A:
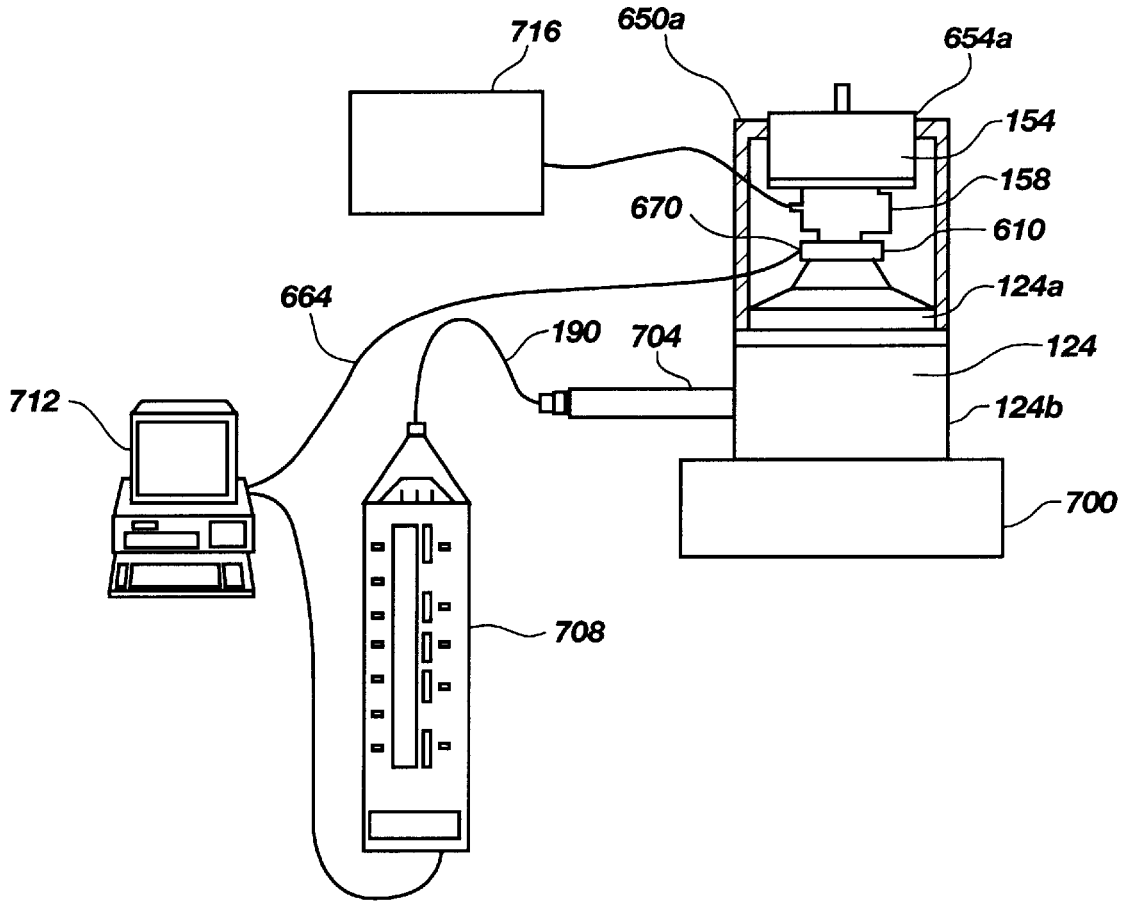
FIG. 9A shows a diagram of a preferred configuration of the components of the present invention.

Referring now to FIG. 9A, there is shown a diagram representing a preferred method for practicing the present invention. The base 124*b* of the artificial ear 124 is placed on a pad 700 which is preferably formed from a soft polyurethane foam. With the base 124*b* of the artificial ear 124 in placed, the coupler 124*c* of the artificial ear is placed on the base and rotated to ensure that it is seated properly.

A microphone preamplifier 704 is connected to the artificial ear 124 at one end and to a sound level meter 708 at the other end. The sound meter 708 is, in turn, connected to a computer 712 which processes the information detected by the microphone in the artificial ear 124.

The artificial mastoid 610 is placed over the opening of the artificial ear 124, and the bone conduction transducer 158 is centered on top of the artificial mastoid 610. The bone conduction transducer is connected to an audiometer 716.

A retention ring or housing 650*a* is placed to rest on the artificial ear 124. The weight 154 is then lowered through a hole 654*a* in the housing so that it rests on top of the bone conduction transducer 158.

Factors such as humidity and room temperature may be entered into the computer 712 to obtain automatically adjusted results, or the calculations may be made manually. Tables presenting the corrections necessary at a particular temperature and frequency are contained in FIG. 11A and corrections for humidity are set forth in FIG. 11B.

Figure 10:
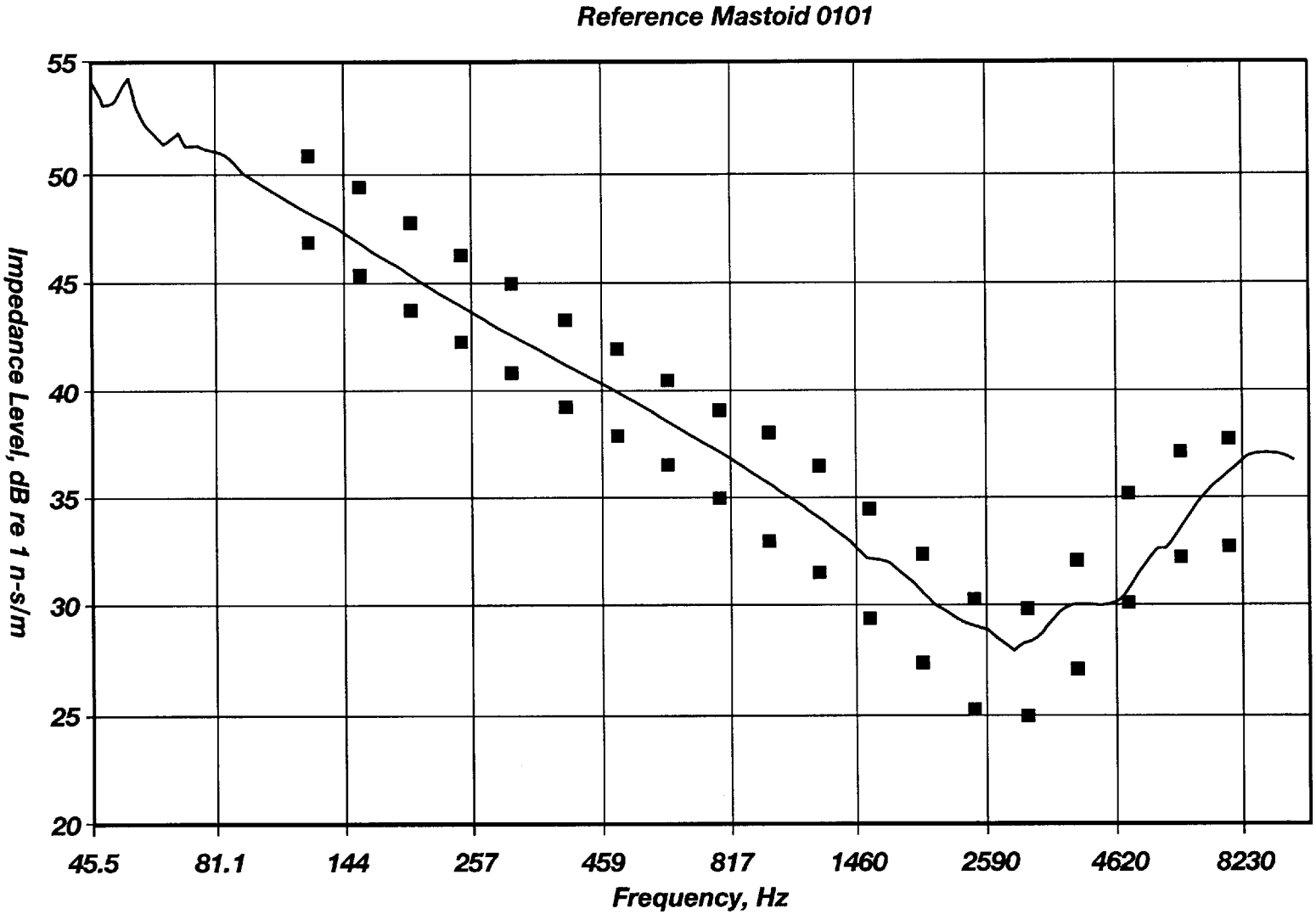
FIG. 10 shows an graph demonstrating an ideal response for an artificial mastoid in accordance with the American National Standard, as well as actual responses from the diaphragm of the present invention shown in FIGS. 8 through 9A.

Referring to FIG. 10, there is shown a graph demonstrating the readings achieved when testing a properly calibrated bone conduction transducer in accordance with the principles of the present invention. While the tests were conducted at 23° C., the temperature sensing means 670 discussed with respect to FIG. 9 enables accurate testing to occur at other temperatures and other environmental conditions as well.

Referring now to FIGS. 11A and 11B, there are shown charts for correcting the data received in light of varying environmental conditions. While the correction for temperature is most significant, the correction for humidity is more complex as it depends on frequency, temperature and relative humidity. Because the correction for humidity is small, it has not normally been measured. Instead, it is placed into broad groups which the average user can use for identifying the appropriate correction.

Thus there is disclosed an apparatus and method for simulating a human mastoid. The apparatus typically consists of a small diaphragm consisting of mass, springiness and damping means to replicate those aspects of a human mastoid (or other head bone) and the skin overlying the same. The diaphragm may be used effectively with a calibrated artificial ear, such as those which are commonly owned by audiologists. While support structures may be provided to retaining the diaphragm, the bone conduction transducer and a weight in their proper places, the diaphragm may be designed to obviate the need for such by nesting within the opening of the artificial ear, or some device serving a similar purpose. Those skilled in the art will recognize numerous modifications which may be made without departing from the scope of the present invention. The appended claims are intended to cover such modifications.

What is claimed is:

1. A diaphragm for simulating a human mastoid when used with an artificial ear, the diaphragm comprising:

a stiffening plate formed from a metal material, the stiffening plate having a void formed therein; and first damping means attached to the stiffening plate and disposed within the void of the stiffening plate;

wherein damping means and the stiffening plate are configured to respond to vibratory force so as to simulate the response of a human mastoid to the vibratory force.

2. The diaphragm of claim 1, wherein the stiffening plate has an upper side and a lower side, and wherein the void is disposed in the upper side, and wherein the diaphragm further comprises second damping means disposed on the lower side of the stiffening plate.

3. The diaphragm of claim 1, wherein the damping means comprises a resilient polymer and a piece of metal.

4. The diaphragm of claim 3, wherein the damping means comprises a first layer formed of a resilient polymer, a second layer formed of metal and a third layer formed of a resilient polymer.

5. The diaphragm of claim 1, wherein the stiffening plate has a lower side, and a flange extending downwardly from the lower side.

6. The diaphragm of claim 1, wherein the stiffening plate has a lower side, and wherein at least one annular groove is formed in the lower side.

7. The diaphragm of claim 6, wherein the diaphragm further comprises a second damping means, and wherein the annular groove is formed to receive a second damping means.

8. The diaphragm of claim 7, wherein the diaphragm further comprises an annular flange disposed adjacent the annular groove formed to receive a second damping means.

9. The diaphragm of claim 7, wherein the diaphragm further comprises a second damping means nested in the annular groove, the second damping means being sized to rest on an opening formed in an artificial ear.

10. The diaphragm of claim 9, wherein the second damping means is formed from a ring of resilient material.

11. The diaphragm of claim 10, wherein at least one of the first and second damping means is formed from a viscoelastic material.

12. The diaphragm of claim 6, wherein the stiffening plate forms a bottom wall beneath the void, and wherein the at least one groove formed in the lower side is an annular groove disposed in the bottom wall.

13. The diaphragm of claim 12, wherein the stiffening plate further comprises an annular flange disposed about the annular groove and extending downwardly from the lower side of the stiffening plate.

14. A diaphragm for simulating a human mastoid when placed over the opening of an artificial ear, the diaphragm comprising:

a stiffening plate formed of a generally rigid material, the stiffening plate being sized larger than the opening of the artificial ear and having an upper side and a lower side;

first damping means disposed on at least part of the stiffening plate, the damping means including a resilient material, the stiffening plate and damping means being configured to simulate vibration in a human mastoid; and nesting means formed in the lower side for limiting lateral movement of the diaphragm when placed to cover the opening of the artificial ear.

15. The diaphragm according to claim 14, wherein the stiffening plate comprises a void, and wherein the first damping means is disposed at least partially within the void.

16. The diaphragm according to claim 14, wherein the first damping means comprises a plurality of layers, at least one of the layers being a resilient material.

17. The diaphragm according to claim 16, wherein at least one of the layers is formed from metal.

18. The diaphragm according to claim 16, wherein at least two of the layers are formed from a resilient polymer.

19. The diaphragm according to claim 14, wherein the nesting means comprises second damping means disposed on the lower side of the stiffening plate.

20. The diaphragm according to claim 19, wherein the lower side of the stiffening plate has an annular groove formed therein, and wherein the second damping means comprises a ring formed of resilient material disposed within said annular groove.

21. The diaphragm according to claim 14, wherein the nesting means comprises a flange extending downwardly from the lower side of the stiffening plate.

22. The diaphragm according to claim 14, wherein the nesting means comprises an annular groove formed in the lower side of the stiffening plate.

23. The diaphragm according to claim 14, wherein the diaphragm weighs between 0.5 and 1.0 grams.

24. The diaphragm according to claim 23, wherein the diaphragm weighs about 0.77 grams.

25. The diaphragm according to claim 14, wherein the diaphragm further comprises temperature sensing means for determining the temperature of the diaphragm.

26. A system for calibrating a bone conduction transducer, the system further comprising:

a housing having a void formed therein with an opening at one end, and a sensor means disposed within the void for detecting vibrational energy within the void and generating signals indicative of the vibrational energy, and a diaphragm configured for vibrating responsive to vibrational forces so as to simulate vibrations of a human mastoid when subjected to the same vibrational forces, wherein the diaphragm is disposable across the opening of the void such that when a bone conduction transducer is applied to the diaphragm, vibration is transferred into the void and detected by the sensor means, the diaphragm simulating the response to vibratory force of a human mastoid.

27. The system of claim 26, wherein the sensor means comprises a microphone.

28. The system of claim 26, wherein the sensor means comprises an accelerometer.

29. The system of claim 26, wherein the diaphragm comprises a stiffening plate and a first damping means disposed in contact with the stiffening plate.

30. The system of claim 29, wherein the diaphragm further comprises second damping means attached to the stiffening plate on a side opposite from the first damping means.

31. The system of claim 26, further comprising processor means disposed in communication with the sensor means for analyzing signals generated by the sensor means.

32. The system of claim 31, wherein the system further comprises temperature sensing means disposed in contact with said diaphragm for determining the temperature of said diaphragm, and generating signals indicative of said temperature.

33. The system of claim 32, further comprising communications means for relaying signals indicative of the temperature to the processor means.

34. A device for simulating a human mastoid when disposed on an artificial ear, the device comprising:

a diaphragm having:

a stiffening plate formed from a generally rigid material, the stiffening plate being size larger than the opening of the artificial ear and having an upper side and a lower side; and first damping means disposed on the upper side of the stiffening plate the stiffening plate and damping means being configured to simulate vibration in a human mastoid; and temperature sensing means disposed in contact with the diaphragm for sensing the temperature of the diaphragm and for producing signals indicative of the temperature of said diaphragm.

35. A method for simulating a human mastoid, the method comprising:

a) selecting a diaphragm having a stiffening plate and a damping means disposed on the stiffening plate configured to simulate a human mastoid;

b) selecting an artificial ear defining a cavity with an opening at one end;

c) positioning the diaphragm over the opening of the artificial ear, so as to cover the opening;

d) applying a vibratory force to diaphragm while the diaphragm is positioned over the opening of the artificial ear; and e) monitoring vibrations within the cavity.

36. The method according to claim 35, wherein the method further comprises generating signals responsive to monitored vibrations within the cavity.

37. The method according to claim 36, wherein the method further comprises generating human perceptible indicia representative of the signals.

38. The method according to claim 37, wherein the method further comprises measuring the temperature of the diaphragm and adjusting the signals responsive to the measured temperature.

39. The method according to claim 38, wherein the method further comprises measuring environmental humidity adjacent the diaphragm and adjusting the signals responsive to the measured humidity.

40. The method according to claim 35, wherein the method comprises, more specifically, selecting a diaphragm configured to nest within the opening in the artificial ear.

41. The method according to claim 35, wherein the method further comprises selecting a processor means and processing the signals generated responsive to the monitored vibrations to produce indicia of the vibratory force applied to the diaphragm.

42. The method according to claim 35, wherein the method comprises, more specifically, applying vibratory force to the diaphragm from a bone conduction transducer.

43. A method for testing a bone conduction hearing aid, the method comprising:

a) selecting an artificial ear having a an opening leading to a void, a microphone being disposed in the void;

b) selecting a diaphragm having a stiffening plate and a damping means configured to simulate a human mastoid bone;

c) positioning the diaphragm over the opening;

d) disposing a bone conduction transducer on the diaphragm opposite the artificial ear;

e) positioning a weight on the bone conduction transducer;

f) operating the bone conduction transducer to apply a vibratory force to the diaphragm; and g) monitoring vibrations within the void by the microphone to determine whether the monitored vibrations fall within a predetermined desired range.

44. The method according to claim 43, wherein the method further comprises:

h) generating signals with the microphone indicative of the monitored vibrations; and i) generating a human perceptible indicia of the vibrations responsive to the signals.

45. The method according to claim 44, wherein the method further comprises monitoring the temperature of the diaphragm and adjusting the generated signals when the monitored temperature is not 23° C.

46. The method according to claim 45, further comprising measuring humidity and adjusting the generated signals responsive to the measured humidity.

* * * * *